US007543811B2

(12) United States Patent
Shimamura

(10) Patent No.: US 7,543,811 B2
(45) Date of Patent: Jun. 9, 2009

(54) SHEET FEEDING APPARATUS AND IMAGE PROCESSING APPARATUS WITH INTERCONNECTED FEEDING UNIT AND SHEET REGULATING MEMBER

(75) Inventor: Masashi Shimamura, Kodama-Gun (JP)

(73) Assignee: Canon Denshi Kabushiki Kaisha, Chichibu-shi (JP)

( * ) Notice: Subject to any disclaimer, the term of this patent is extended or adjusted under 35 U.S.C. 154(b) by 544 days.

(21) Appl. No.: 11/208,615

(22) Filed: Aug. 23, 2005

(65) Prior Publication Data

US 2006/0038339 A1 Feb. 23, 2006

(30) Foreign Application Priority Data

Aug. 23, 2004 (JP) ..... 2004-241946

(51) Int. Cl.
*B65H 3/52* (2006.01)

(52) U.S. Cl. ..... 271/124; 271/117; 271/241

(58) Field of Classification Search ..... 271/117, 271/118, 124, 241
See application file for complete search history.

(56) References Cited

U.S. PATENT DOCUMENTS 4,905,984 A * 3/1990 Haigh ..... 271/270
6,307,621 B1 10/2001 Endo et al. ..... 355/407
6,792,241 B2 9/2004 Nakagawa et al. ..... 399/367
2003/0026633 A1 * 2/2003 Nakagawa et al. ..... 399/367

FOREIGN PATENT DOCUMENTS

JP 06305595 A * 11/1994
JP 8-310668 11/1996
JP 3335973 8/2002
JP 2003-40475 2/2003

* cited by examiner

*Primary Examiner*—Patrick H Mackey
*Assistant Examiner*—Gerald W McClain
(74) *Attorney, Agent, or Firm*—Fitzpatrick, Cella, Harper & Scinto

(57) ABSTRACT

A sheet feeding apparatus including a feeder for feeding sheets stacked up in a sheet stock unit, a leading end regulator for regulating the leading ends in a feeding direction of sheets stacked up in the sheet stock unit, and a driver for moving the leading and regulating member. The feeder unit is free to contact with or depart from the sheets, the leading end regulator is movable in a sheet feeding route between a regulating position for regulating the leading ends of sheets, and a retreat position for releasing the leading end of the sheets from regulation by moving away from the sheet feeding route, and the leading end regulator contacts with and supports the lower end of the feeding unit holding the feeding unit at a position apart from the sheets when the leading end and regulator is at the regulating position, and brings the feeding unit into contact with the sheets releasing the support to the feeder without contacting with the lower end thereof when the leading end regulator is at the retreat position.

3 Claims, 7 Drawing Sheets

SHEET FEEDING APPARATUS AND IMAGE PROCESSING APPARATUS WITH INTERCONNECTED FEEDING UNIT AND SHEET REGULATING MEMBER

This application claims the benefit of priority from Japanese Patent Application No. 2004-241946, filed on Aug. 23, 2004, the entire contents of which are incorporated by reference herein.

BACKGROUND OF THE INVENTION

1. Field of the Invention

The present invention relates to a sheet feeding apparatus, and an image processing apparatus including this sheet feeding apparatus.

2. Description of the Related Art

Hitherto, an original feeding apparatus used in a scanner, copying machine, or the like, includes leading end regulating means for regulating leading ends of originals stacked up in an original stock unit, and a pickup roller for picking up and conveying stacked originals. The original feeding apparatus further includes a separating apparatus for separating and conveying the plural picked up and conveyed originals by one sheet each. The leading end regulating means is disposed between the pickup roller and the separating apparatus. The leading end regulating means prevents the leading end of an original from being pushed into the separating apparatus when the user stacks up a pile of originals on the original stock unit. The leading end regulating means also functions to align the leading ends of originals set by the user in the original stock unit. The pickup roller is movable to a position away from the stacking space so as not to hinder the user from stacking up the originals in the original stock unit.

Originals stacked up in the original stock unit are released from regulation of original leading ends of the original when the leading end regulating means is moved away. Then, the pickup roller descends to the top of the stacked originals and presses the originals from above. By the pickup roller, the originals are picked up and conveyed toward the separating apparatus. Driving means for moving the leading end regulating means, and driving means for raising or lowering the pickup roller, are individually provided. Or, for moving the leading end regulating means, and for raising or lowering the pickup roller, individual drive mechanisms using clutches and cams are respectively provided. Besides, as disclosed in Japanese Patent Application Laid-Open (JP-A) No. 8-310668, No. 2003-40475, and Japanese Patent Publication No. 3335973, by making use of lifting and lowering motion of the pickup roller, it is proposed to regulate the swing or the release of the regulation of the leading end regulating means.

SUMMARY OF THE INVENTION

In the prior art, however, individual driving means or individual driving mechanisms are used for moving the position of the leading end regulating means for regulating the leading ends of the originals, and for driving the pickup roller in a lifting and a lowering motion. Hence, it has been difficult to reduce the size and to lower the cost of the apparatus.

In the technologies disclosed in JP-A No. 8-310668, No. 2003-40475, and Japanese Patent Publication No. 3335973, the originals conveyed by the pickup roller are released from the swing regulation, and are advanced forward by pushing away the leading end regulating means located at the leading end regulating position. Therefore, when feeding thin originals, for example, leading ends of originals may be folded.

Further, in the technologies disclosed in JP-A No. 8-310668 and Japanese Patent Publication No. 3335973, the escaping direction of swingable leading end regulating means is above the originals. Hence, if the leading end of an original is curled to the upper side, the leading end of an original may be rolled into the leading end regulating means, which is pushed away upward, and paper feeding may be disturbed.

The invention is devised to solve the problems of the prior art, and it is an object thereof to provide a sheet feeding apparatus simplified in the structure of leading end regulating means and the pickup roller lifting and lowering mechanism. It is another object of the invention to provide a sheet feeding apparatus capable of feeding a wide variety of sheets smoothly, while lowering the cost by reducing the size of the apparatus and curtailing the number of parts.

A representative configuration of the invention for achieving the objects includes a feeding unit for feeding sheets stacked up in a sheet stock unit, and a leading end regulating member for regulating the leading ends in a feeding direction of sheets stacked up in the sheet stock unit, in which the feeding unit is provided so as to contact with or move away from the sheets, and the leading end regulating member moves between a regulating position for regulating the leading end of a sheet in the sheet conveying route, and a retreat position for releasing from a leading end regulation of a sheet by moving away from the sheet conveying route, the leading end regulating member holds the feeding unit at a position away from the sheets at the regulating position, and brings the feeding unit into contact with sheets at the retreat position.

According to the invention, the lifting and lowering drive mechanism of feeding means required hitherto can be omitted, and the apparatus size is reduced, the number of parts is curtailed, and the cost is lowered, and further, various types of sheets can be fed smoothly, including thin sheets and curled sheets, so that the reliability of the apparatus is enhanced.

DESCRIPTION OF THE PREFERRED EMBODIMENT

Figure 1:
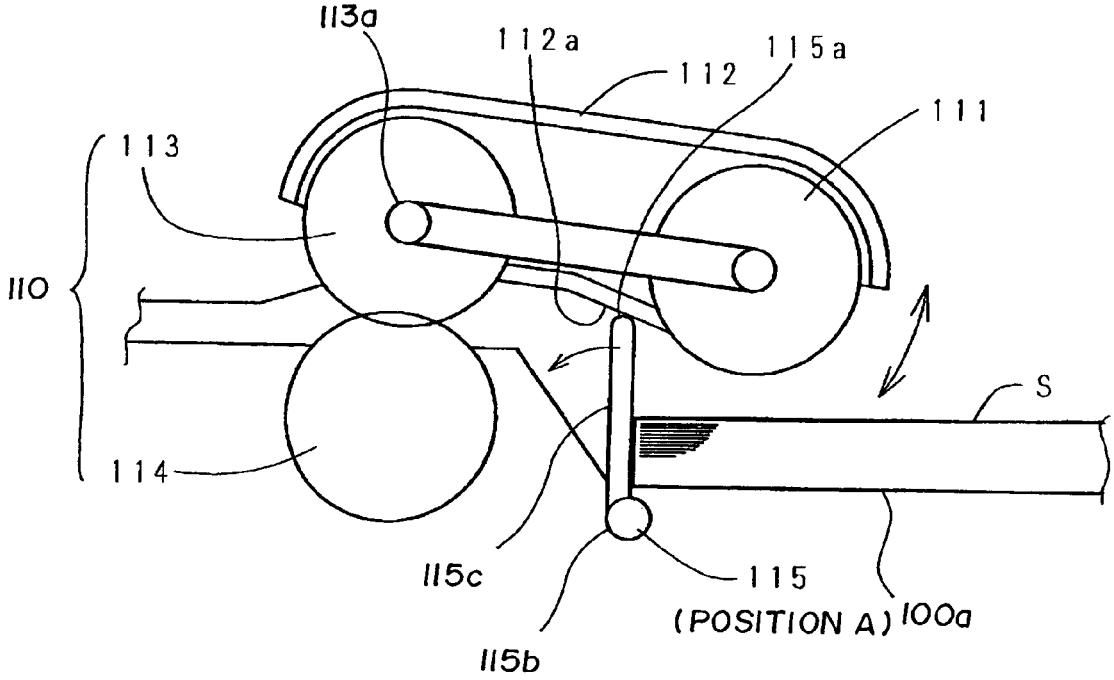
FIG. 1 is an essential side sectional view of a peripheral area of a sheet regulating member of a sheet feeding apparatus according to a first embodiment.

Referring now to the drawings, preferred embodiments of the invention are specifically described below.

The following embodiments relate to a sheet feeding apparatus for originals intended to feed originals or sheets like originals to be read one by one. The invention is not limited to this example, alone, but the same effects are obtained when it is applied in a sheet feeding apparatus for printing a medium intended to feed recording papers or other sheets to be recorded one by one.

The following embodiments show an example of an image reading apparatus as an image processing apparatus. But not limited to this example alone, the invention may also be applied to a printer or other image processing apparatus, including an image recording unit for recording an image on a sheet to be recorded. The invention is also applicable to an image reading unit for reading an image on a sheet to be read. Further, the invention is applicable to a copying machine, including an image recording unit for recording an image on a sheet to be recorded, other image processing apparatus, such as a facsimile apparatus, or other image processing apparatuses, such as a complex machine combining these functions. The same effects are obtained by applying the invention in the sheet feeding apparatus used in such an image processing apparatus.

In the following embodiments, a sheet feeding apparatus integrally incorporated in an image processing apparatus is explained, but the invention is not limited to this embodiment alone, and the sheet feeding apparatus may be detachable from the image processing apparatus, and the same effects are obtained by applying the invention in the sheet feeding apparatus.

First Embodiment

Figure 7:
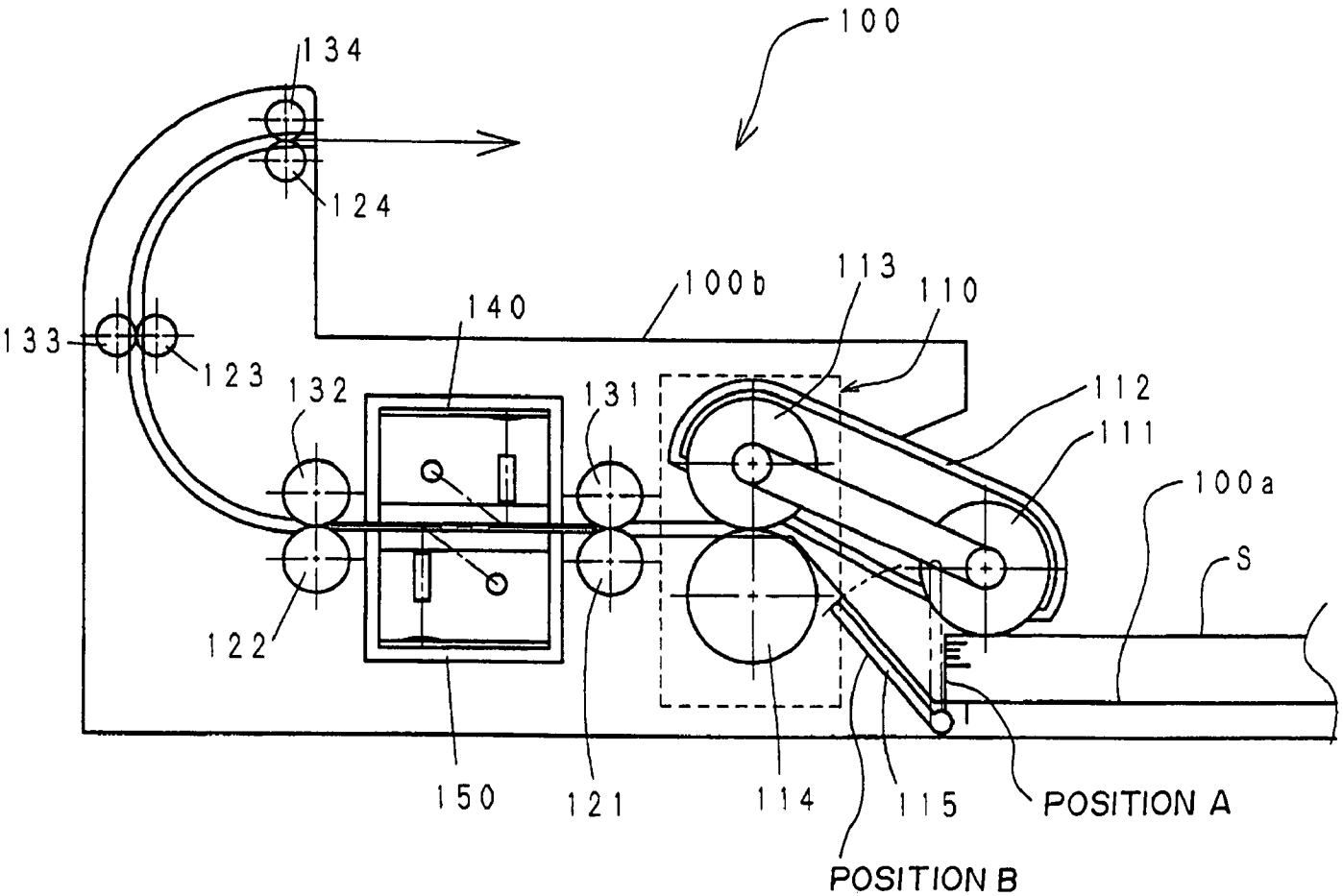
FIG. 7 is a schematic side sectional view showing a mode of an image reading apparatus including a sheet feeding apparatus according to the invention.

A first embodiment of the invention is explained with reference to the drawings. FIG. 7 is a schematic side sectional view showing a mode of an image reading apparatus including a sheet feeding apparatus according to the invention.

In FIG. 7, reference numeral 100 is an image reading apparatus, reference numeral 100*a* is a sheet stock unit for stacking up sheets S, such as originals and other sheets S to be read, and reference numeral 100*b* is a discharge stock unit for stacking up sheets S discharged after an image reading process.

Reference numeral 111 is a pickup roller as feeding means. The pickup roller 111 feeds sheets S stacked up in the sheet stock unit 100*a* toward the inside of the apparatus. This pickup roller 111 is supported by a roller holding member 112. The roller holding member 112 is supported rotatably about shaft 113*a* of a feed roller 113 described below. The pickup roller 111 is supported movably between the abutting position abutting against the top of sheets S stacked up in the sheet stock unit 100*a* and the departing position not disturbing the stacking, about the shaft 113*a* of the feed roller 113. The feeding unit is composed of pickup roller 111 and roller holding member 112.

Reference numeral 115 is a sheet regulating member as leading end regulating means. The sheet regulating member 115 is intended to prevent the leading ends of sheets set by the user in the sheet stock unit 100*a* from being pushed into the separating apparatus 110. The sheet regulating member 115 is also to align the leading ends of sheets. The sheet regulating member 115 is designed to move away from the conveying route of sheets S when the image forming apparatus starts a scanning operation. The sheet regulating member 115 is capable of swinging on the lower side as a hinge. The sheet regulating member 115 is a member capable of selecting a standing state and an inclined state. The sheet regulating member 115 is held in a standing state in a stopped state of the image reading apparatus 100, that is, the regulating position (POSITION A in FIG. 1) for regulating the leading ends of sheets S. At this regulating position, the sheet regulating member 115 abuts against a part of the roller holding member 112 supporting the pickup roller 111. The sheet regulating member 115, abutting against a part of the roller holding member 112, is capable of holding the pickup roller 111 at a departing position (retreat position), not disturbing stacking of the sheets S.

Reference numeral 110 is a separating apparatus (separating means) for sorting a plurality of sheets into each sheet. The separating apparatus 110 is composed of a feed roller 113 rotating normally in a conveying direction, and a separating roller 114 rotating reversely. The separating apparatus 110 separates the sheets fed by the pickup roller 111 into each sheet, and conveys to the downstream side. As shown in an overall configuration of the image forming apparatus in FIG. 7, registration roller pair 121, 131 are disposed at the downstream side in a conveying direction of sheets S of separating apparatus 110. The registration roller pair 121, 131 conveys the sheets separated by the separating apparatus 110. The registration roller 121 is driven by a main motor (not shown) so as to be rotatable normally and reversely, and by rotating normally, sheets are conveyed to the downstream side. Similarly, in FIG. 7, reference numerals 122, 123, 134 are conveyance rollers for conveying sheets S at a predetermined speed. Reference numerals 132, 133, 134 are driven rollers being driven and rotated by conveyance rollers 121, 122, 123, 124. The driving conveyance rollers 122, 123, 124 form a pair with driven rollers 132, 133, 134, respectively, and hold and convey the sheets. Reference numerals 140, 150 are a face image reading unit and a back image reading unit, and can selectively read front and back images of sheets S being conveyed.

An image reading operation of the image reading apparatus 100 having such a configuration is explained below. When an image reading operation is started, the sheet regulating member 115 moves from the upright regulating position for regulating the leading ends of sheets (double dotted chain line position in FIG. 7, POSITION A) to the inclined retreat position set aside to the lower side of the conveying route (solid line position in FIG. 7, POSITION B). By the movement of the sheet regulating member 115 to the retreat position, the pickup roller 111 descends, and abuts against the top of the sheets S stacked up in the sheet stock unit 100*a*, and picks up and conveys the sheets S. The sheets S being picked up and conveyed are securely sorted into each sheet by the separating apparatus 110, and conveyed by roller pairs consisting of conveyance rollers 121, 122 and driven rollers 131, 132. The sheets conveyed by conveyance rollers 121, 122 and driven rollers 131, 132 pass through while tightly contacting with front image reading unit 140 and back image reading unit 150.

The image of sheet S is read by the front image reading unit 140 and back image reading unit 150. That is, the image formed on the front or back of the sheet S is scanned while passing through the front image reading unit 140 or back image reading unit 150, and the front or back image information is issued outside as an electrical signal. After the image is read, the sheet S is conveyed by roller pairs of conveyance rollers 123, 124, and driven rollers 133, 134, and discharged into the discharge stock unit 100*b*.

Figure 2:
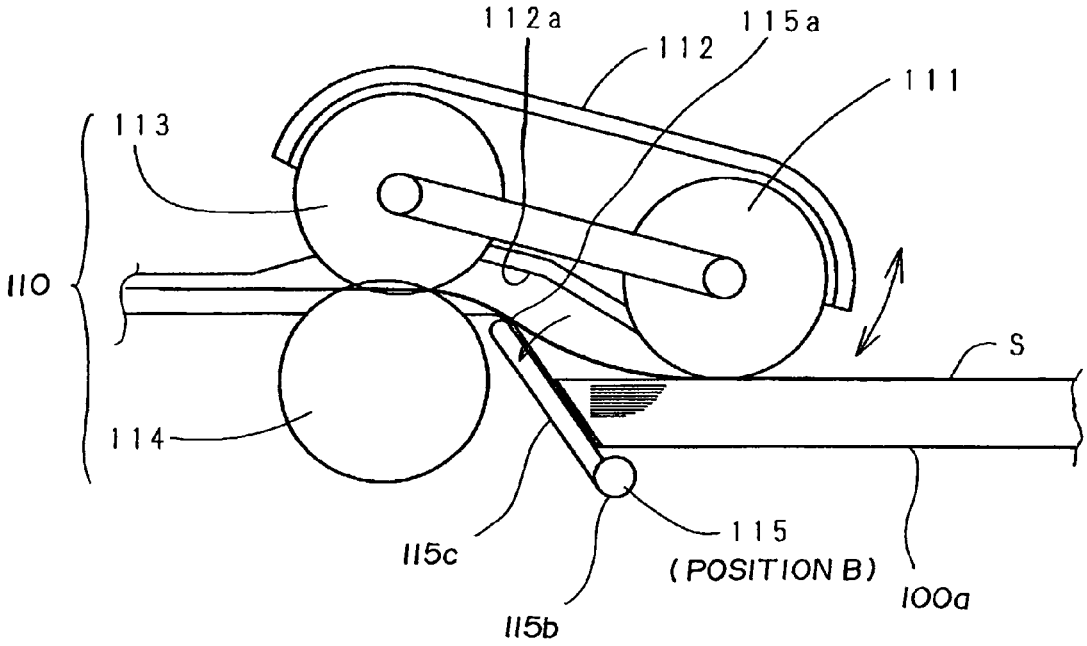
FIG. 2 is an essential side sectional view of a peripheral area of a sheet regulating member of a sheet feeding apparatus according to the first embodiment.
Figure 3:
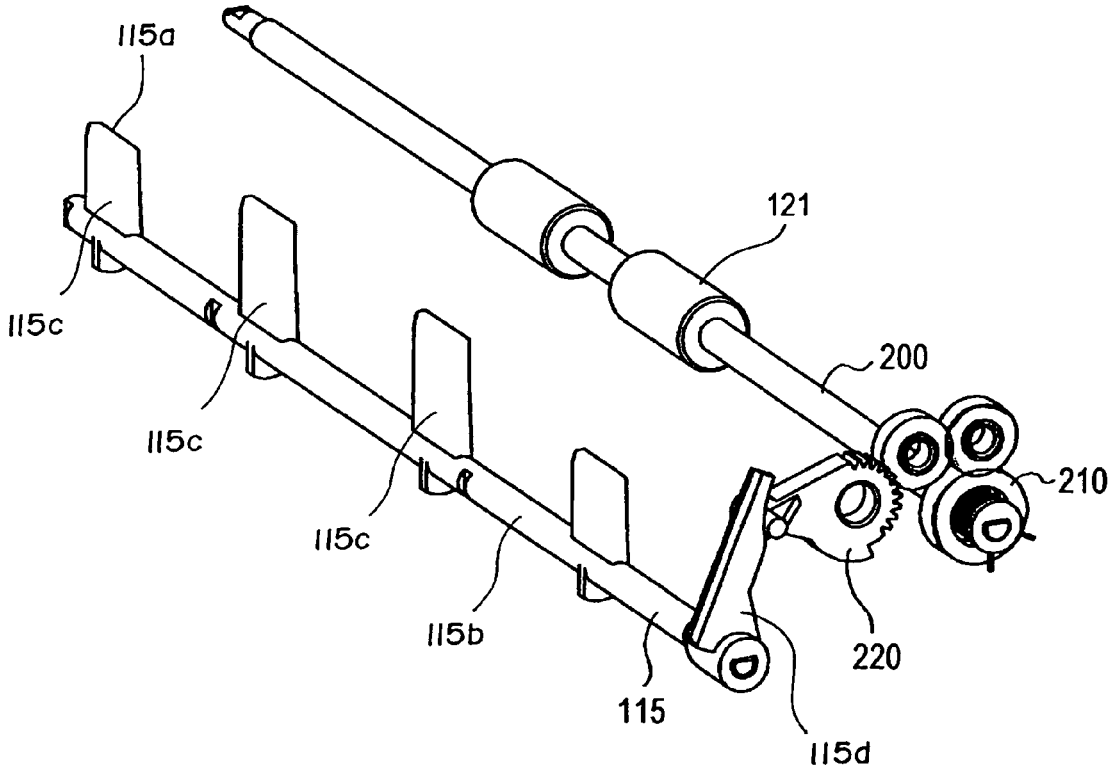
FIG. 3 is a perspective view of a configuration of a driving mechanism of a sheet feeding apparatus in the first embodiment.

Referring to FIG. 1 to FIG. 3, the sheet feeding apparatus in the image reading apparatus according to the first embodiment of the invention is more specifically described below. FIG. 1 and FIG. 2 are side sectional views of essential parts in the peripheral area of the sheet regulating member. FIG. 3 is a perspective view of a configuration of a drive mechanism of a sheet regulating member.

The sheet feeding apparatus in the image reading apparatus includes, as described above, pickup roller 111 for feeding the sheets S stacked up in the sheet stock unit 100*a*, and separating apparatus 110 for separating the plurality of sheets S into each sheet. The sheet feeding apparatus further includes a sheet regulating member 115 for regulating the leading ends in the feeding direction of sheets S stacked up in the sheet stock unit 100*a*.

Further, as mentioned above, the pickup roller 111 is provided so as to contact with or depart from the sheets S. The sheet regulating member 115 is designed to move between the regulating position for regulating the leading ends of sheets S shown in FIG. 1 in the sheet feeding route, and the retreat position for releasing from regulation of leading ends of sheets S shown in FIG. 2 by moving away from the sheet feeding route. The drive mechanism for moving the position of the sheet regulating member 115 is explained later.

The sheet regulating member 115 moves to the regulating position shown in FIG. 1, and abuts against the oscillating roller holding member 112, which supports the pickup roller 111. As the sheet regulating member 115 abuts against the roller holding member 112, the pickup roller 111 is moved away from the top of the sheets S, and the sheet regulating member 115 supports the pickup roller 111 at a retreat position not contacting with the top of sheets S. By this movement to the retreat position shown in FIG. 2, this support is released, and the pickup roller 111 is allowed to contact with the sheets S.

The drive mechanism of the sheet regulating member, and the relation between the sheet regulating member and the pickup roller are explained below.

As shown in FIG. 3, the sheet regulating member 115 is composed of a swing shaft 115*b*, a plurality of poking members 115*c* for poking the leading ends of sheets S mounted on the swing shaft 115*b*, and a work arm 115*d* attached to the end of the swing shaft 115*b*. Further, as shown in FIG. 3, the drive mechanism of the sheet member regulating member 115 is composed of a cam member 220 for changing over the position of the sheet regulating member 115, and a spring clutch mechanism 210 provided between the cam member 220 and shaft 200 of registration roller 121. The spring clutch mechanism 210 is provided at one end of the shaft 200 of the registration roller 121, and when the shaft 200 rotates reversely, a driving force is transmitted. When the shaft 200 rotates reversely, the spring clutch mechanism 210 rotates integrally with the shaft 200, and the cam member 220 is rotated clockwise by the shown gear train. When the cam member 220 swings, the cam member 220 abuts against the leading end of the work arm 115*d* of the sheet regulating member 115, and the poking members 115*c* of the sheet regulating member 115 are located at the regulating position shown in FIG. 1. When this operation is done after finishing the paper feeding operation, the next setting of a sheet block is easier. When a paper feeding operation starts, the spring clutch mechanism 210 is allowed to rotate freely in the same direction by the shaft 200 rotating in a normal direction. In other words, when the shaft 200 rotates in normal direction, the cam member 220 is free to rotate in a counterclockwise direction. The sheet regulating member 115 is a forcing spring F as a forcing member. This forcing member F forces the sheet regulating member 115 in a direction away from the original conveying route. Accordingly, when the leading end of the cam member 220 is moved downward, by the forcing effects of the forcing spring F, the work arm 115*d* of the sheet regulating member 115 is tilted, and the swing shaft 115*b* swings. In cooperation with a swing of the swing shaft 115*b*, the poking members 115*c* are inclined. As a result, the sheet regulating member 115 moves from the original conveying route to the retreat position shown in FIG. 2 (POSITION B).

The drive mechanism of the sheet regulating member 115 is not limited to the configuration explained above, and similar effects are obtained by using, for example, a solenoid.

The roller holding member 112 has a contact surface 112*a* to contact with the leading end portion 115*a* of the sheet regulating member 115 as shown in FIG. 1 and FIG. 2. When the sheet regulating member 115 moves to the regulating position for regulating the leading ends of sheets S, as shown in FIG. 1, the leading end portion 115*a* of the sheet regulating member 115 abuts against the contact surface 112*a* of the roller holding member 112. When the leading end portion 115*a* of the sheet regulating member 115 abuts against the contact surface 112*a* of the roller holding member 112, the roller holding member 112 is pushed up. As the roller holding member 112 is pushed up, the pickup roller 111 is raised to depart (retreat) from the top of the sheets S, as shown in FIG. 2. Thus, the position is changed over, and the sheet regulating member 115 is responsible for the lifting and lowering motion of the pickup roller 111. Therefore, a drive mechanism for the lifting and lowering motion of the pickup roller 111 can be omitted, and the apparatus is reduced in size, the number of parts is curtailed, and the cost is reduced.

Further, as shown in FIG. 2, the sheet regulating member 115 moves to the retreat position to depart completely from the sheet conveying route so as not to disturb sheet feeding (regulation release position, POSITION B). Therefore, any thin sheet or curled sheet can be fed smoothly without being caught in the sheet regulating member 115, and various types of sheets can be fed smoothly, and the reliability of the apparatus is enhanced.

Second Embodiment

Figure 4:
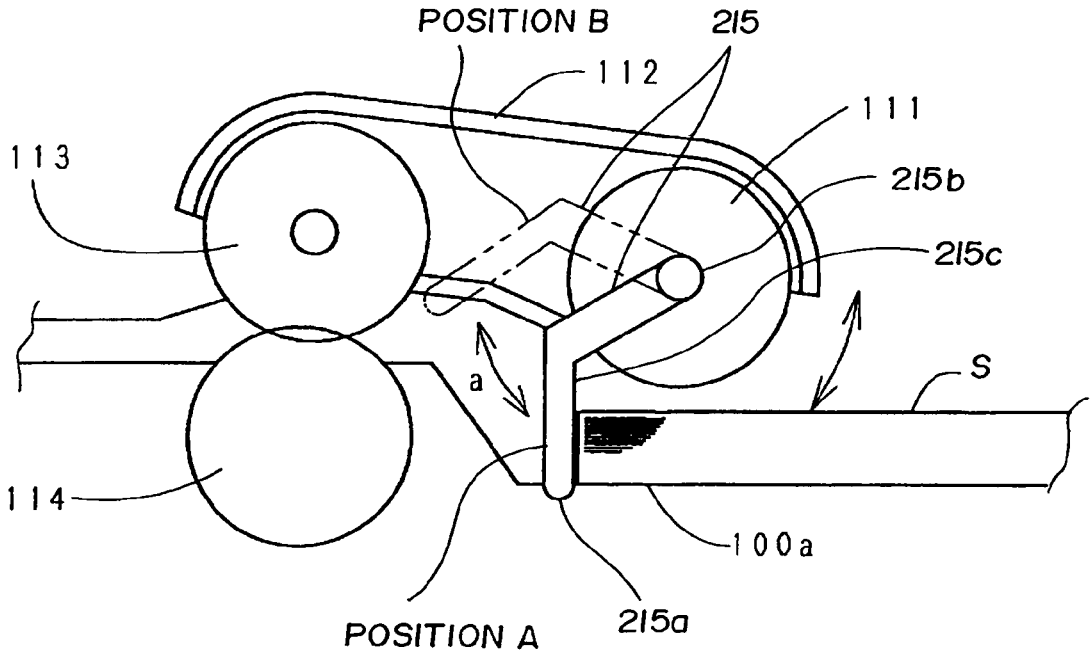
FIG. 4 is an essential side sectional view of a peripheral area of a sheet regulating member of a sheet feeding apparatus according to a second embodiment.
Figure 5A:
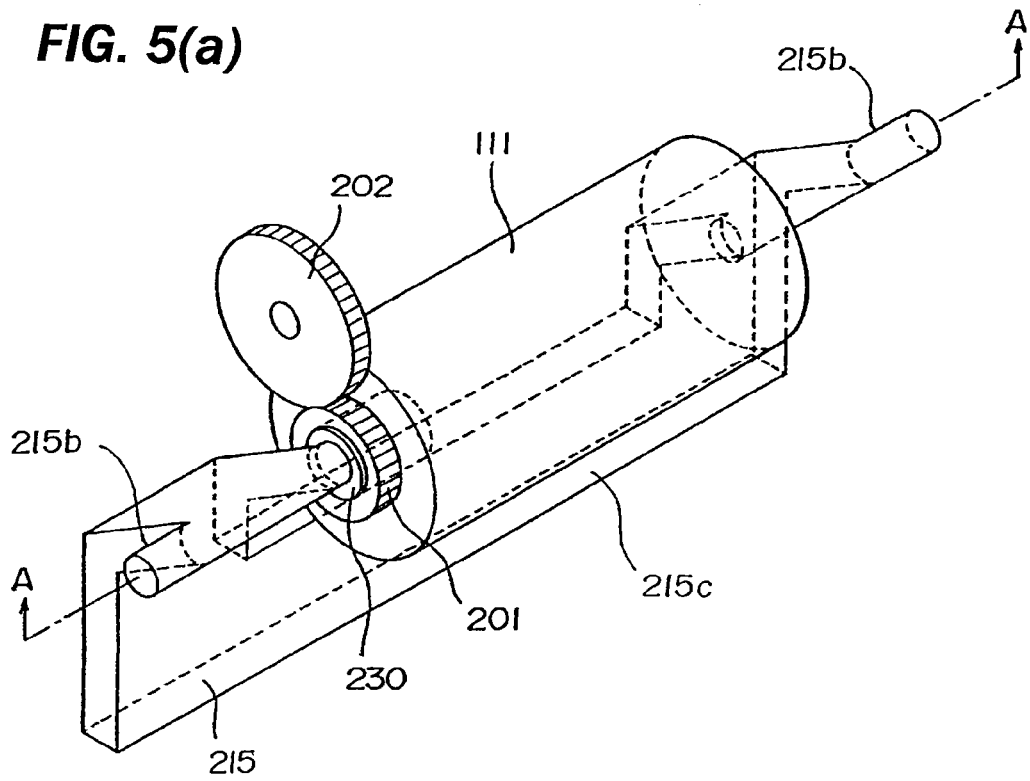
FIGS. 5(*a*) and 5(*b*) show essential parts of a sheet feeding apparatus in the second embodiment, in which FIG. 5(*a*) is a perspective view of a peripheral area of a pickup roller, and FIG. 5(*b*) is an A-A sectional view of FIG. 5(*a*).
Figure 5B:
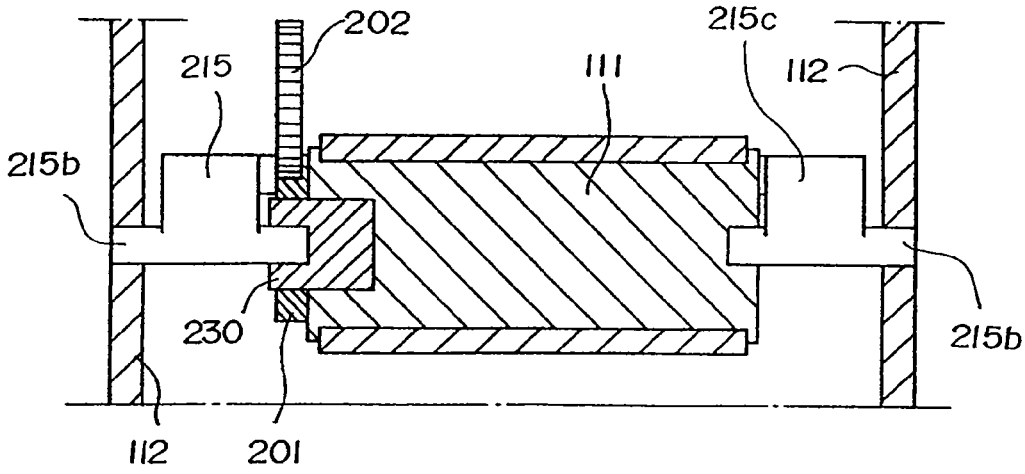

A second embodiment of the invention is described by referring to the drawings. FIG. 4 is an essential side sectional view of a peripheral area of a sheet regulating member of a sheet feeding apparatus in the second embodiment. FIG. 5(*a*) and FIG. 5(*b*) show essential parts of a sheet feeding apparatus in the second embodiment, FIG. 5(*a*) is a perspective view of a peripheral area of a pickup roller, and FIG. 5(*b*) is an A-A sectional view of FIG. 5(*a*).

A general overall configuration of an image reading apparatus, including the sheet feeding apparatus, is the same as in the foregoing embodiment, and the same members are identified with the same reference numerals, and an explanation is not described. Characteristic portions of the embodiment are described below.

In this configuration, as shown in FIG. 4 and FIGS. 5(*a*) and 5(*b*), a sheet regulating member 215 is provided on a pickup roller 111 so as to be rotatable coaxially.

The pickup roller 111 is rotated and driven by a drive transmission mechanism of gears and other components provided at the roller end. As shown in FIGS. 5(*a*) and 5(*b*), a torque limiter 230 is provided inside the pickup roller 111 coaxially with the roller 111. A roller gear 201 is integrally provided at the end of the pickup roller 111, and this roller gear 201 is engaged with driving force transmission gear 202 for transmitting a driving force to the pickup roller 111. The sheet regulating member 215 of the embodiment includes a swing shaft 215*b* provided horizontally to the upper side, and a poking member 215*c* extending downward from the swing shaft 215*b* and deflected in the middle. The swing shaft of the pickup roller 111 and the swing shaft 215*b* of the sheet regulating member 215 are coaxial. A driving force is transmitted to the swing shaft 215*b* of the sheet regulating member 215 through the torque limiter 230 in the same direction as the rotating direction of the pickup roller 111. Therefore, the sheet regulating member 115 moves in the direction of arrow a shown in FIG. 4, but is stopped by a stopper (not shown), so as not to move further from the regulating position indicated by the solid line or retreat position (POSITION B) indicated by a double dotted chain line.

The motion of sheet regulating member 215 and pickup roller 111 is explained. At the home position, the sheet regulating member 215 is in an upright (inverted) state, and the sheet regulating member 215 is located at the regulating position for regulating the leading ends of sheets S (solid line position in FIG. 4; POSITION A). While the sheet regulating member 215 is at the regulating position, the sheet regulating member 215 is supporting the pickup roller 111 (and roller holding member 112), so that the pickup roller 111 may be apart from the top of sheets S. At this time, the leading end portion 215*a* of the sheet regulating member 215 contacts the sheet stock unit 100*a*.

When the pickup roller 111 begins to rotate in the sheet feeding direction, the sheet regulating member 215, provided coaxially on the pickup roller 111, swings to incline from the regulating position indicated by a solid line in FIG. 4 (POSITION A) to the retreat position indicated by a double dotted chain line (POSITION B). At this time, the leading end portion 215*a* of the sheet regulating member 215 departs from the sheet stock unit 100*a*. When the leading end portion 215*a* of the sheet regulating member 215 departs from the sheet stock unit 100*a*, support of the pickup roller 111 by the sheet regulating member 215 is released. As the support of the pickup roller 111 by the sheet regulating member 215 is released, the pickup roller 111 is allowed to abut against the top of the sheets S. Then, the sheet regulating member 215 is inclined from the upright state (inverted state), and is moved away from the sheet feeding route. The sheet regulating member 215 is stopped at the retreat position indicted by a double dotted chain line in FIG. 4 by means of a stopper (not shown). If the sheet regulating member 215 stops, rotation of the pickup roller 111 is not disturbed by the action of the torque limiter 230.

When all sheets in the sheet stock unit are fed, or interruption of sheet feeding is instructed, the pickup roller 111 rotates reversely. The sheet regulating member 215 receives this reverse driving force by way of the torque limiter 230. Therefore, the sheet regulating member 215 moves from the retreat position indicated by double dotted chain line in FIG. 4 toward the regulating position indicated by a solid line in FIG. 4, and finally, returns to the regulating position for regulating the leading ends of sheets. As the sheet regulating member 215 returns to the regulating position, again, the pickup roller 111 is moved to the retreat position not contacting with the top of sheets S.

According to the embodiments, the same effects as in the foregoing embodiment can be obtained, and further complicated structure of each driving force transmission route can be avoided, because the sheet regulating member 215 is provided rotatably on the pickup roller 111 coaxially.

Other Embodiment

FIGS. 5(*a*) and 5(*b*) are diagrams of a paper feeding and conveying apparatus in a third embodiment.

Figure 6:
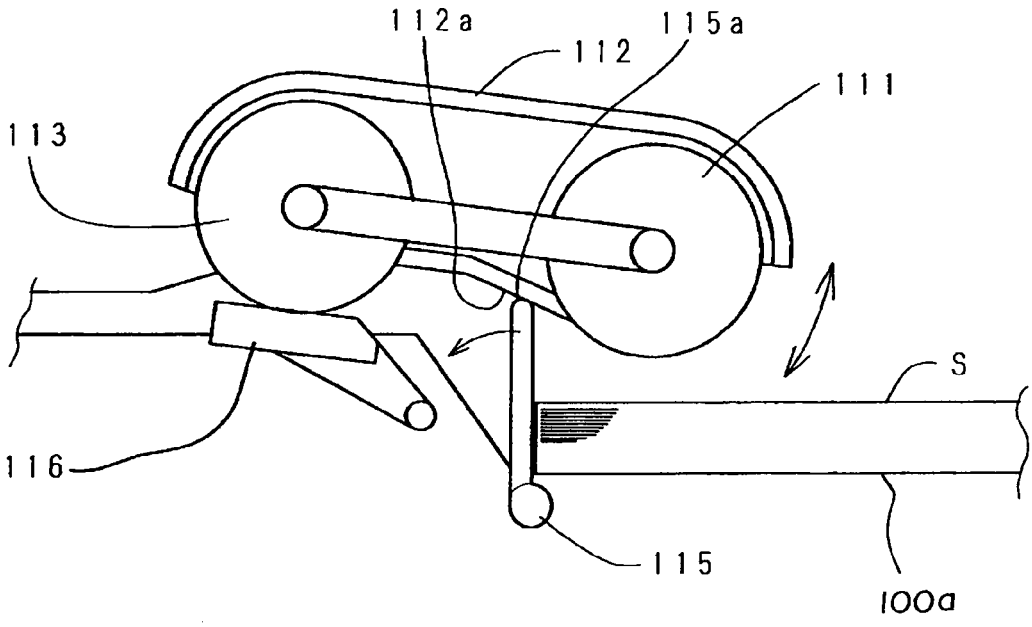
FIG. 6 is an essential side sectional view of a peripheral area of another type of a sheet regulating member of a sheet feeding apparatus according to the invention.

In the foregoing embodiments, the separating apparatus 110 is composed of feed roller 113 and separation roller 114, but the invention is not limited to this structure alone, and, for example, the separating apparatus may be composed of feed roller 113 and separation pad 116, and by using such a separating apparatus, the same effects as in the foregoing embodiments may be obtained, as shown in FIG. 6.

What is claimed is:

1. A sheet feeding apparatus comprising:

a feeding unit for feeding sheets stacked up in a sheet stock unit;

a leading end regulating member for regulating the leading ends in a feeding direction of sheets stacked up in the sheet stock unit; and a driving mechanism for moving the leading end regulating member, wherein the feeding unit is free to contact with or depart from the sheets, the leading end regulating member is movable in a sheet feeding route between a regulating position for regulating the leading ends of the sheets, and a retreat position for releasing leading ends of the sheets from regulation by moving away from the sheet feeding route, and the leading end regulating member contacts with and supports the lower end of the feeding unit holding the feeding unit at a position apart from the sheets when the leading end and regulating member is at the regulating position, and brings the feeding unit into contact with the sheets releasing the support to the feeding unit without contacting with the lower end thereof when the leading end regulating member is at the retreat position.

2. The sheet feeding apparatus according to claim 1, wherein the leading end regulating member has a swing shaft, and swings between a standing state and an inclined state, and matches the leading ends in the feed direction of the sheets, and in the inclined state allows feeding of the sheets by the feeding unit.

3. An image processing apparatus comprising:

an image reading unit for reading an image from a sheet to be read, wherein a sheet feeding apparatus for feeding the sheets to be read toward the image reading unit is provided by the sheet feeding apparatus as set forth in claim 1.

* * * * *